US007694399B2

(12) United States Patent
Sawdon et al.

(10) Patent No.: US 7,694,399 B2
(45) Date of Patent: Apr. 13, 2010

(54) SHEET FASTENING APPARATUS AND METHOD

(75) Inventors: Edwin G Sawdon, St. Clair, MI (US); Steven J Sprotberry, Marysville, MI (US)

(73) Assignee: BTM Corporation, Marysville, MI (US)

( * ) Notice: Subject to any disclaimer, the term of this patent is extended or adjusted under 35 U.S.C. 154(b) by 1397 days.

(21) Appl. No.: 11/072,837

(22) Filed: Mar. 4, 2005

(65) Prior Publication Data

US 2006/0196034 A1 Sep. 7, 2006

(51) Int. Cl.
*B23P 11/00* (2006.01)
*B21D 39/00* (2006.01)

(52) U.S. Cl. ..... 29/243.53; 29/243.5; 29/283.5; 29/524.1; 29/509; 72/466.4

(58) Field of Classification Search ..... 29/798, 29/243.5, 243.53, 283.5, 509, 524.1, 21.1; 72/466.4, 466.5, 466.8
See application file for complete search history.

(56) References Cited

U.S. PATENT DOCUMENTS

| | | | | |
|---|---|---|---|---|
| 1,190,696 | A | 7/1916 | Wilzin | |
| 2,393,986 | A | 2/1946 | Gullberg | |
| 3,730,044 | A | 5/1973 | Sawdon | |
| 4,208,776 | A * | 6/1980 | Schleicher | 29/243.5 |
| 4,459,735 | A | 7/1984 | Sawdon | |
| 4,574,453 | A | 3/1986 | Sawdon | |
| 4,574,473 | A | 3/1986 | Sawdon | |
| 4,660,403 | A | 4/1987 | Slasinski | |
| 4,722,647 | A | 2/1988 | Sawdon | |
| 4,757,609 | A | 7/1988 | Sawdon | |
| 4,878,284 | A | 11/1989 | Sawdon | |
| 4,910,853 | A | 3/1990 | Sawdon | |
| 4,947,719 | A | 8/1990 | Whistler | |
| 5,027,503 | A | 7/1991 | Sawdon | |
| 5,046,228 | A | 9/1991 | Eckold et al. | |
| 5,150,513 | A | 9/1992 | Sawdon | |
| 5,177,861 | A | 1/1993 | Sawdon | |
| 5,208,973 | A | 5/1993 | Sawdon | |
| 5,208,974 | A | 5/1993 | Sawdon et al. | |
| 5,267,383 | A | 12/1993 | Sawdon | |
| 5,338,599 | A | 8/1994 | Barrett | |
| 5,339,509 | A | 8/1994 | Sawdon et al. | |
| 5,435,049 | A | 7/1995 | Sawdon | |
| 5,479,687 | A | 1/1996 | Sawdon | |
| 5,509,290 | A * | 4/1996 | Faivre | 72/395 |
| 5,528,815 | A * | 6/1996 | Webb | 29/509 |
| 5,581,860 | A | 12/1996 | Sawdon | |

(Continued)

FOREIGN PATENT DOCUMENTS

| | | |
|---|---|---|
| CA | 2 374 217 | 11/2000 |

(Continued)

*Primary Examiner*—Essama Omgba
(74) *Attorney, Agent, or Firm*—Harness, Dickey & Pierce, P.L.C.

(57) ABSTRACT

A sheet fastening apparatus and method are provided. In another aspect of the present invention, a die assembly for forming a joint between sheets of material is disclosed wherein the die assembly includes an anvil, at least one die blade disposed adjacent to and overlapping a punch-side of the anvil, a flexible retainer, and a shield that coaxially and radially surrounds a portion of the anvil and/or die blade.

39 Claims, 6 Drawing Sheets

U.S. PATENT DOCUMENTS

| | | | | |
|---|---|---|---|---|
| 5,695,867 | A | 12/1997 | Saitoh et al. | |
| 5,709,019 | A | 1/1998 | Sawdon | |
| 5,727,302 | A | 3/1998 | Sawdon | |
| 5,737,819 | A | 4/1998 | Sawdon et al. | |
| 5,782,130 | A | 7/1998 | Sawdon | |
| 5,860,315 | A | 1/1999 | Sawdon | |
| 5,984,563 | A * | 11/1999 | Wu | 403/282 |
| 6,092,270 | A | 7/2000 | Sawdon | |
| 6,115,898 | A | 9/2000 | Sawdon | |
| 6,430,795 | B1 | 8/2002 | Sawdon et al. | |
| 6,612,007 | B1 * | 9/2003 | Wade | 29/243.5 |
| 6,684,479 | B2 * | 2/2004 | Wang et al. | 29/521 |
| 6,757,951 | B2 | 7/2004 | Sawdon et al. | |
| 6,785,959 | B2 | 9/2004 | Sawdon et al. | |
| 7,003,861 | B2 * | 2/2006 | Sawdon et al. | 29/432 |
| 7,322,086 | B2 * | 1/2008 | Humpert et al. | 29/243.5 |
| 2004/0045153 | A1 | 3/2004 | Rapp | |

FOREIGN PATENT DOCUMENTS

| | | |
|---|---|---|
| DE | 37 26 392 | 2/1989 |
| WO | WO 01/76788 | 10/2001 |

* cited by examiner

SHEET FASTENING APPARATUS AND METHOD

BACKGROUND AND SUMMARY OF THE INVENTION

The present invention relates generally to fastening apparatuses and more particularly to a fastening apparatus for forming a clinch joint between sheets of material.

It is common within the metal forming industry to join overlapping workpiece sheets by punching or otherwise deforming them to cause an interlocking relationship in a localized area. Many of these traditional joints, however, have typically required shearing of the sheet material. Thus, these joints tend to leak rain water and also have their corrosion resistant coatings destroyed.

More recently, an apparatus has been used for joining two or more sheets of material together by creating a leakproof and secure joint. These improved conventional joints are created by use of a punch acting against an anvil to produce what is known as a TOG-L-LOC® clinch joint therebetween. Such a leakproof joint and tooling are disclosed in U.S. Pat. Nos. 5,267,383 and 5,177,861, both of which are entitled "Apparatus for Joining Sheet Material" and U.S. Pat. No. 5,727,302, entitled "Die and Punch for Forming a Joint and Method of Making the Die," all of which issued to Sawdon. The disclosures of these patents are incorporated by reference herein. These conventional leakproof joints have seen commercial success for use in varied applications such as microwave oven home appliances and automotive vehicle parts.

Other traditional die configurations are known. For example, U.S. Patent Publication No. 2004/0045153 entitled "Method and Tool for Producing A Press Joint Connection" shows pairs of spaced apart die segments retained by individual leaf springs and their associated screws. This traditional construction, however, leaves the moving die components fully exposed to the harsh environment of a typical manufacturing plant such that the die segments appear to be susceptible to falling off of the die, and the spring interfaces to the die segments and screws may be worn or deformed over time through inadvertent workpiece contact or die vibration.

In accordance with the present invention, a sheet fastening apparatus and method are provided. In another aspect of the present invention, a single biasing member is configured to retain movable die blades in a die assembly while allowing outward movement of the die blades relative to a central anvil. A further aspect of the present invention provides multiple die blades each having a partially circular punch-side shape at their overlap with an anvil. In yet another aspect of the present invention, a die assembly for forming a joint between sheets of material is disclosed wherein the die assembly includes an anvil, at least one die blade disposed adjacent to and overlapping a punch-side of the anvil, a flexible retainer, and a shield that coaxially and radially surrounds a portion of the anvil and/or die blade. In still another aspect of the present invention, die blades have an interior undercut and the die blades contact each other in at least one operating condition. Methods of making and using a die assembly that is used for forming a joint between at least two sheets of material are also provided.

The present invention is advantageous over prior constructions since the present invention improves joint quality by minimizing overly deep drawing of soft material workpieces, such as aluminum sheets. Thus, joint tearing or cracking is reduced. The present invention is further advantageous since the die assembly is less expensive to manufacture, simple to assemble, and more durable, robust and protected in use than many traditional devices. Moreover, the present invention apparatus advantageously allows joining of three or more material sheets. The apparatus of the present invention is ideally suited for joining together aluminum/polymer/aluminum composite panels used to reduce noise. Additional advantages and features of the present invention will become apparent from the following description and appended claims, taken in conjunction with the accompanying drawings.

DETAILED DESCRIPTION OF THE PREFERRED EMBODIMENT

Figure 1:
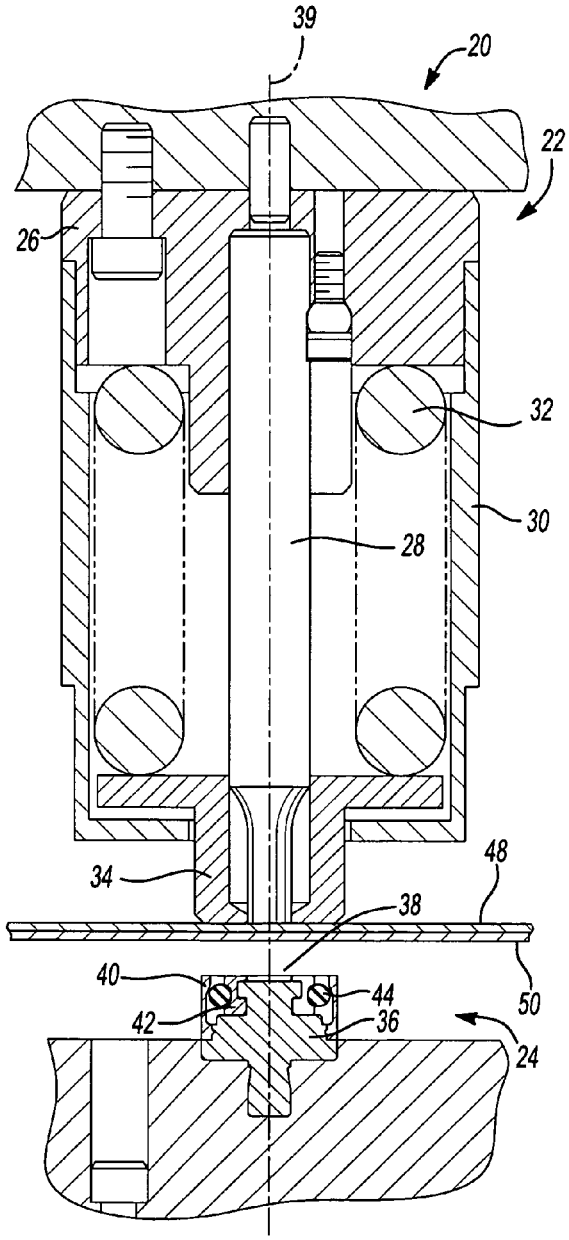
FIG. 1 is a longitudinal, cross sectional view showing the preferred embodiment of a sheet fastening apparatus of the present invention.
Figure 2:
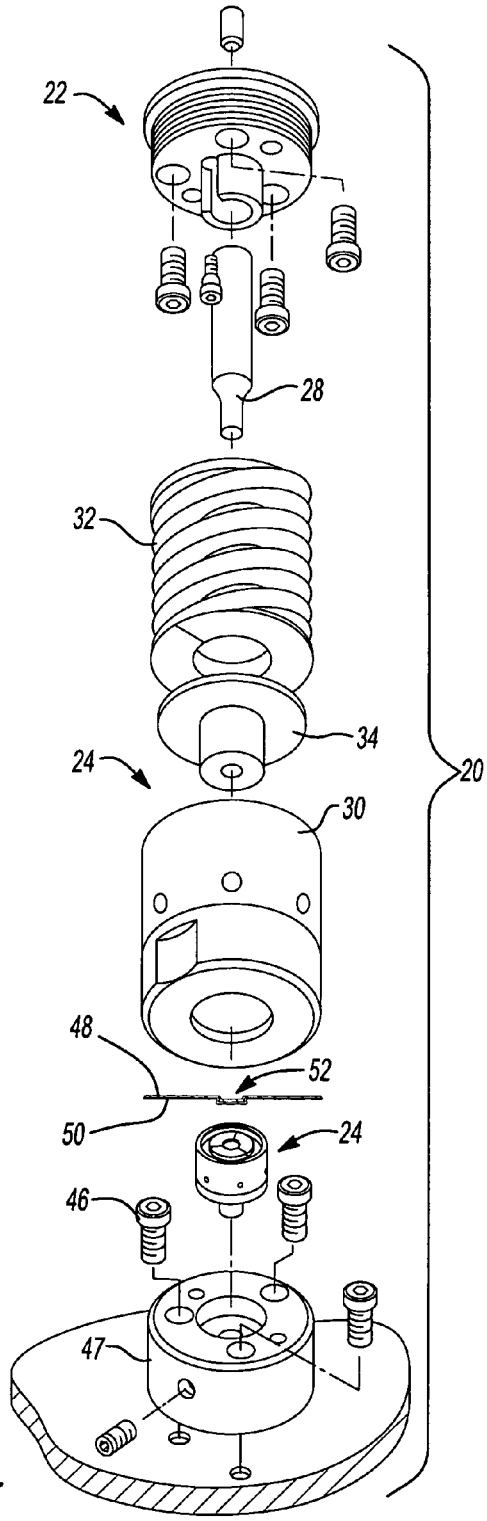
FIG. 2 is an exploded perspective view showing the preferred embodiment apparatus.
Figures 3, 4:
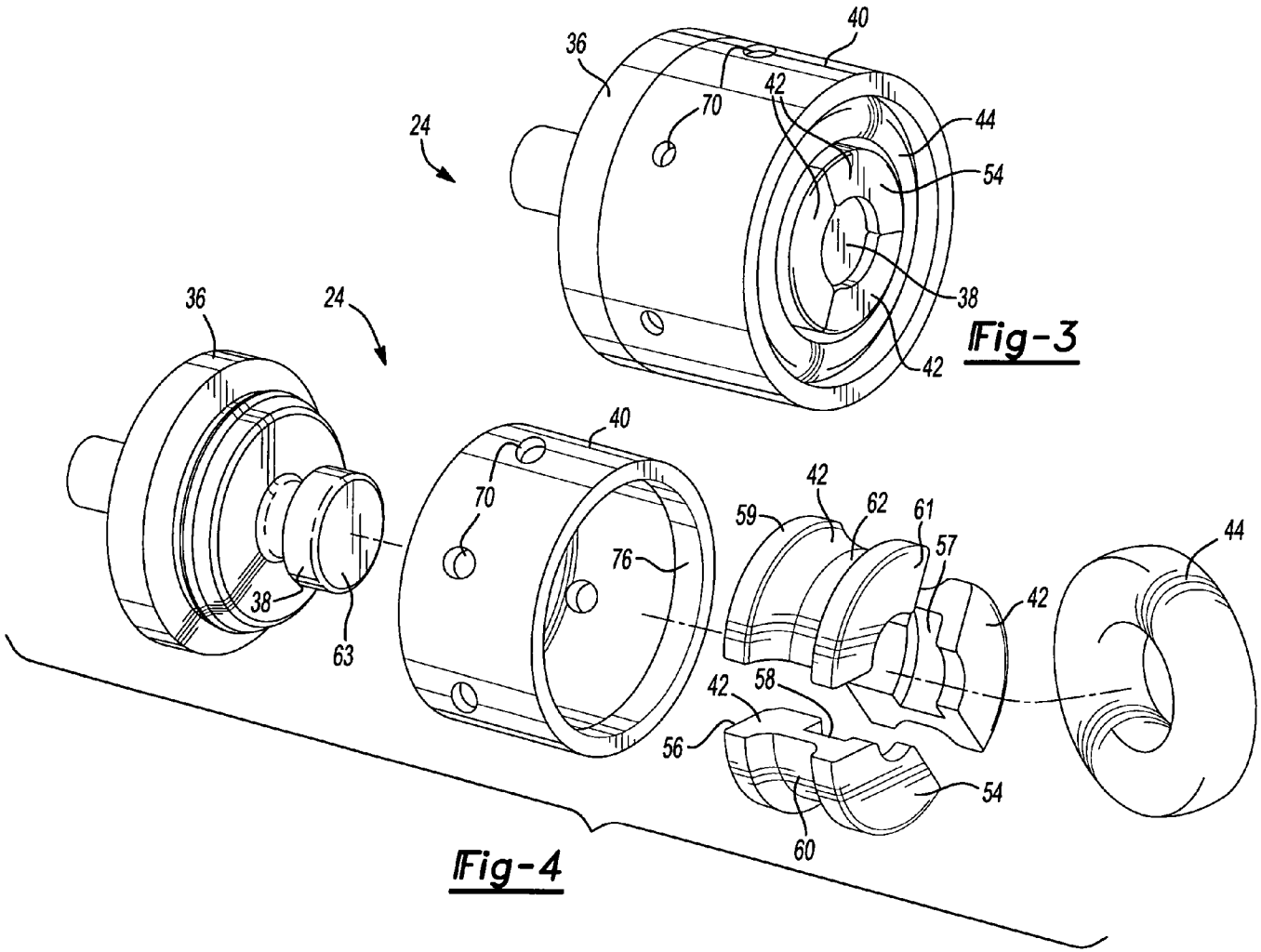
FIG. 3 is a perspective view showing a die assembly employed in the preferred embodiment apparatus.
FIG. 4 is an exploded perspective view showing the die assembly employed in the preferred embodiment apparatus.

Referring to FIGS. 1 and 2, the preferred embodiment fastening tool assembly 20 of the present invention employs a punch assembly 22 and a die assembly 24. Punch assembly 22 is pneumatically driven and made in accordance with U.S. Pat. No. 5,727,302. Punch assembly 22 includes a punch holder 26, a punch 28, a housing 30, a compression spring 32 and a stripper 34. Aligned therewith, the preferred die assembly 24 includes a die body 36 having a stationary anvil 38, with a longitudinal axis 39, a shield or guard 40, three movable die blades 42, a flexible retainer 44, mechanical fasteners, such as bolts 46, and a die holder 47. Two or three sheets of workpiece material 48 and 50, such as aluminum, are deformed between punch assembly 22 and die assembly 24 so as to create an interlocking clinch joint 52, which is preferably a leak proof joint.

Figure 5:
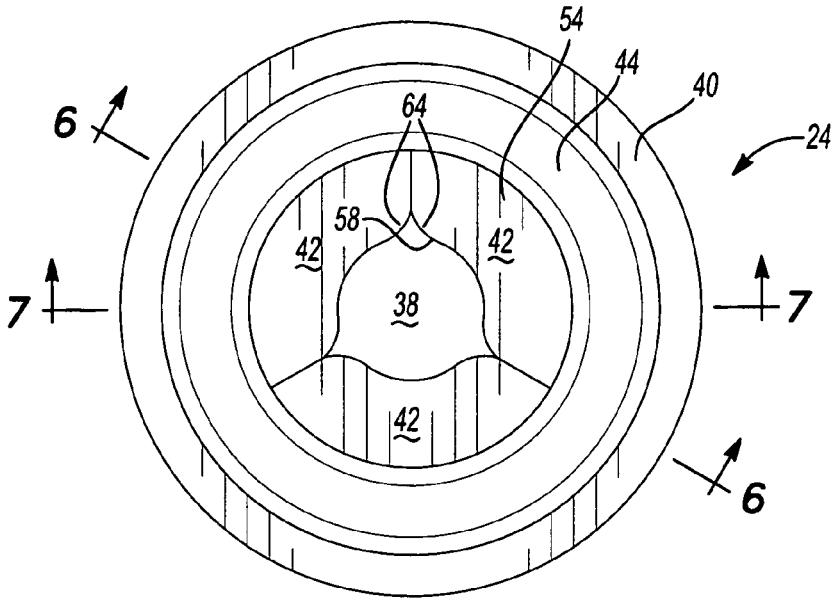
FIG. 5 is a top elevational view showing the die assembly employed in the preferred embodiment apparatus.
Figure 6:
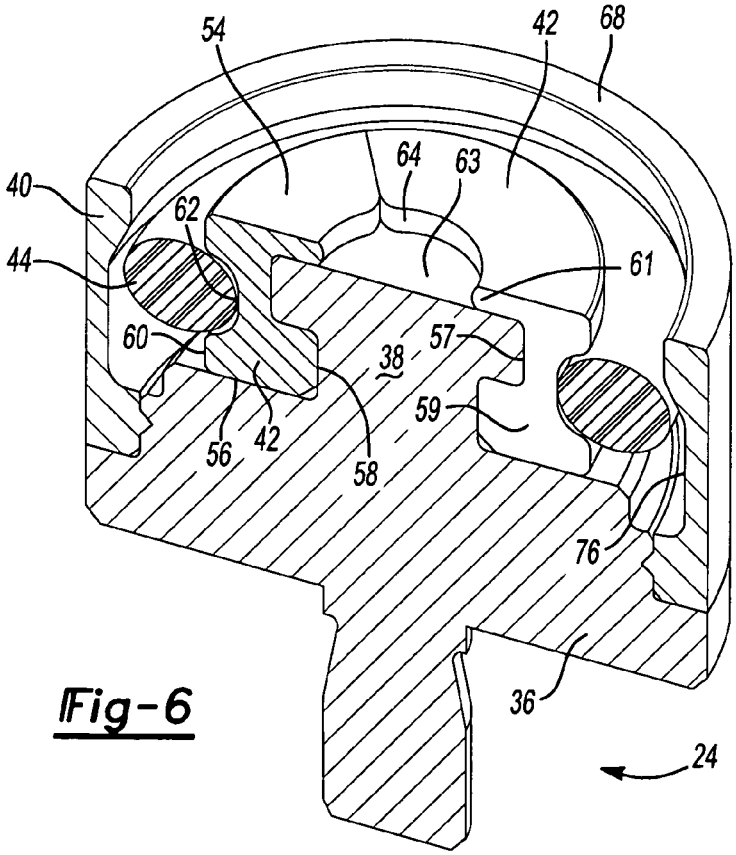
FIG. 6 is a perspective cross sectional view, taken along line 6-6 of FIG. 5, showing the die assembly employed in the preferred embodiment apparatus, disposed in a nominal position.

Referring to FIG. 3-8, each die blade 42 has axially opposite upper and lower surfaces 54 and 56, respectively, and radially opposite inner and outer surfaces 58 and 60, respectively. The upper and lower surfaces are generally flat and parallel. Die blades 42 are positioned circumferentially around anvil 38 with inner surfaces 58 in contact with anvil 38. Each die blade 42 has a generally I-like cross sectional shape such that inner surface 58 has a semi-circular elongated and undercut groove 57 separating a base 59 from a cap 61. This configuration provides a wrap-over or overlap between cap 61 of each die blade 42 and a punch-side surface 63 of anvil 38. Outer surface 60 of each die blade 42 has an elongated semi-circular recess 62 between cap 61 and base 59. Adjacent edges of die blades 42 contact each other such that the three die blades 42 define a generally circular top view shape (as shown in FIG. 5). Furthermore, die blades 42 have radiused corners 64 at each cap 61 thereby defining somewhat triangular points at the interior interface between the die blades.

Figure 7:
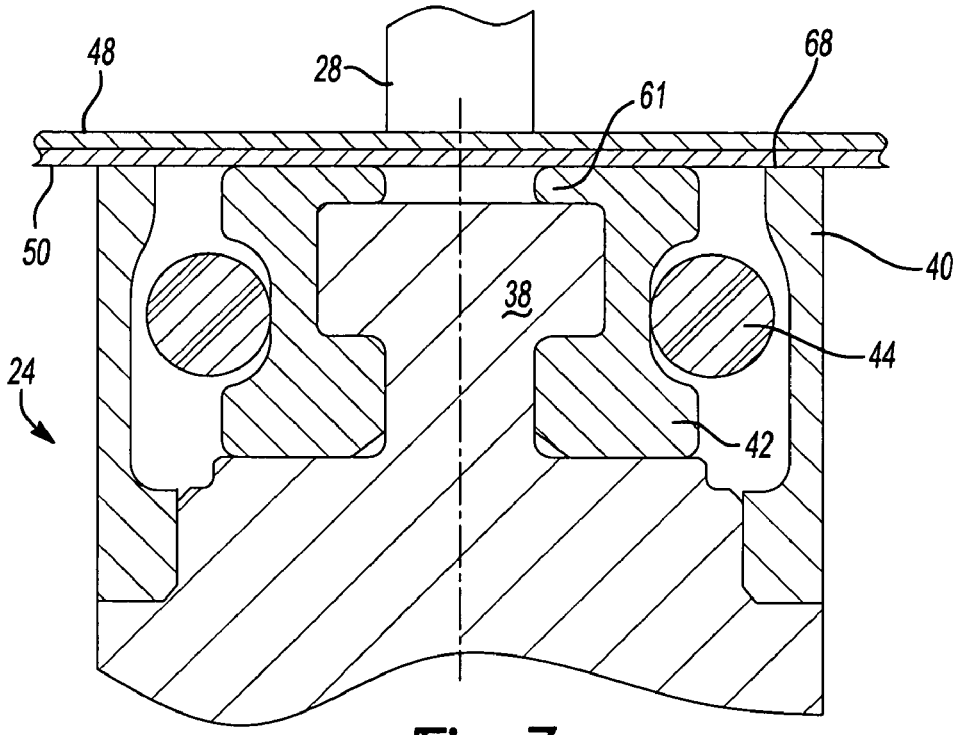
FIG. 7 is a cross sectional view, taken along line 7-7 of FIG. 5, showing the die assembly and a punch employed in the preferred embodiment apparatus, disposed in the nominal position.
Figure 8:
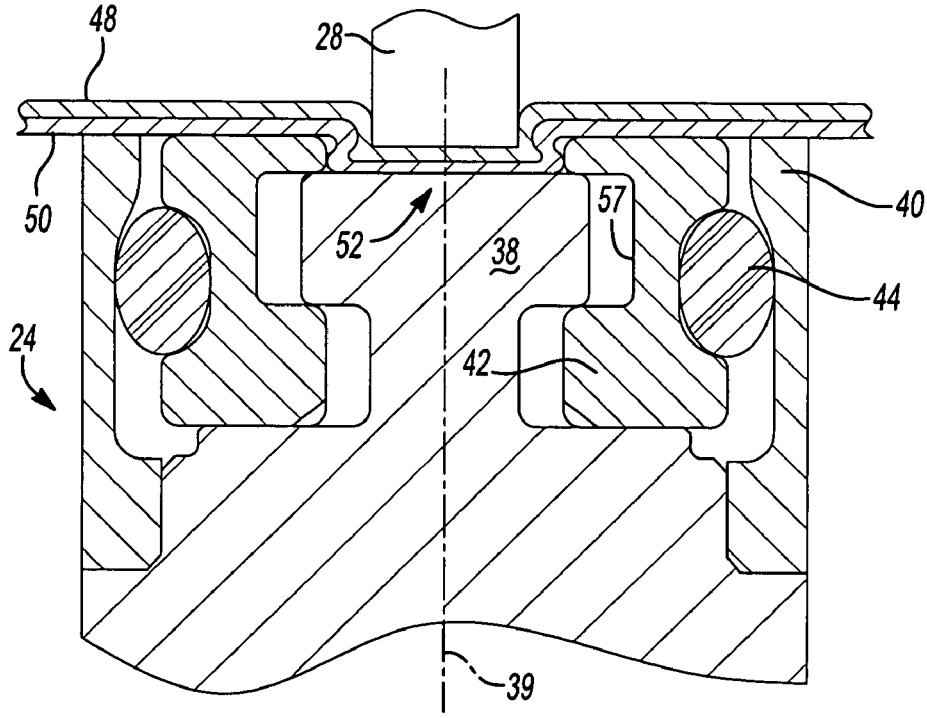
FIG. 8 is a cross sectional view, like that of FIG. 7, showing the die assembly and punch employed in the preferred embodiment apparatus, disposed in a joint forming and expanded position.
Figure 12:
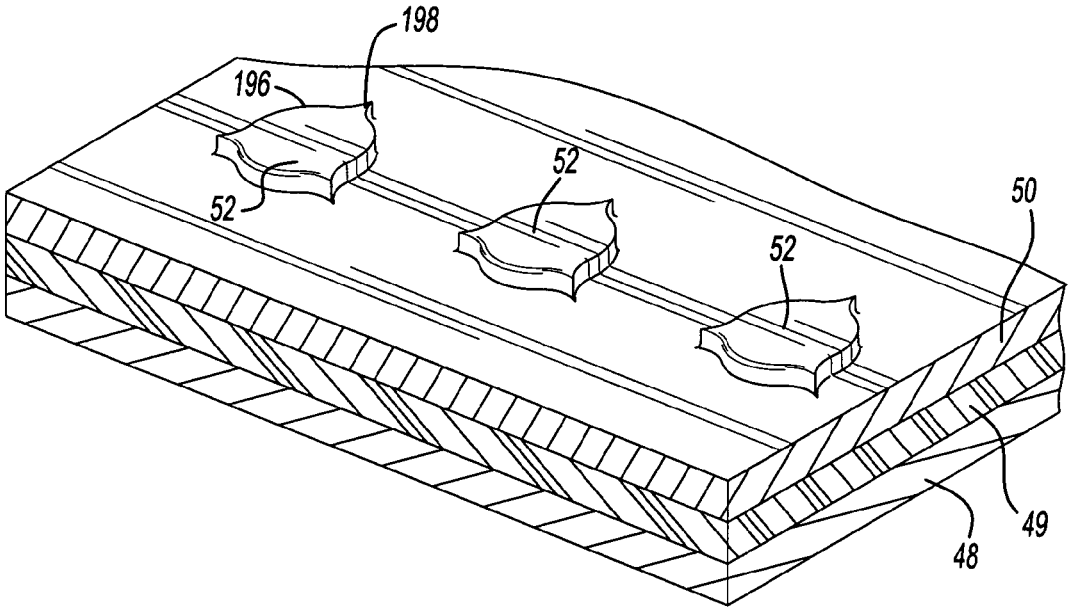
FIG. 12 is a perspective view showing joints created in laminate workpieces employing the preferred embodiment apparatus.

Upper surface 54 of each die blade 42 is substantially coplanar with an upper edge 68 of shield 40 as can be seen in FIGS. 7 and 8. This coplanar nature of the upper surfaces 54 of die blades 42 and upper edge 68 of shield 40 provides for improved support of material sheets 48 and 50 during joint formation and removal from die assembly 24. Material sheets 48, 50 are preferably aluminum but may alternately be mild steel or a laminate sandwich (see FIG. 12) of aluminum 48, polymer 49 and aluminum 50 such as that disclosed in U.S. Pat. No. 5,695,867 entitled "Reinforcing and Vibration-Damping Material" which issued to Saitoh et al. on Dec. 9, 1997; and U.S. Pat. No. 5,338,599 entitled "Vibration-Damping Structural Component" which issued to Barrett on Aug. 16, 1994; both of which are incorporated by reference herein.

Die shield 40 includes six apertures 70 that extend between its inner and outer surfaces. The inner surface has an annular recess 76 configured to engage with a portion of retainer 44. Shield 40 can be attached to die body 36 in a variety of ways. For example, shield 40 is preferably snap fit onto body 36 or, alternately, it can be retained with mechanical fasteners (not shown) or even made as a single piece with the body. Apertures 70 allow for self cleaning of die assembly 24. Such self cleaning is achieved during normal movement of die blades 42 and retainer 44. Accordingly, any lubricating or cooling fluid as well as dirt, sheet material oil and other debris may be expelled through apertures 70. It should alternately be appreciated that the shield may be lower or higher relative to the anvil, however, various advantages of the present invention may not be realized. The die blades, shield and die body are all preferably machined from M2 steel. The die body and die blades are chromium nitride coated, hardened and ground to Rc 57-61, while the shield is titanium nitride coated, hardened and ground to Rc 42-46. Furthermore, the workpiece-interfacing end of the anvil is polished.

Retainer 44 is preferably an elastomeric O-ring that is positioned in die assembly 24 so that the retainer radially encircles or surrounds all of the die blades 42 concentrically about anvil 38. An inner surface of retainer 44 engages with outer surface 60 of die blades 42 within recess 62 to retain and bias die blades 42 against anvil 38. An outer surface of retainer 44 engages with inner recess 76 of shield 40 to help retain die blades 42 and retainer 44 within die assembly 24. This configuration prevents die blades 42 from falling out of die assembly 24 when the die assembly is being moved around or inverted while also allowing die blades 42 to move radially outwardly when forming the interlocking clinch joint 52, as can be seen by comparing FIGS. 7 and 8.

Interlocking clinch joint 52 is formed by longitudinally advancing punch 28 toward die assembly 24 such that punch 28 compresses and deforms material sheets 48 and 50 within the opening between caps 61 of die blades 42 and against anvil 38. As can be observed by comparing FIGS. 7 and 8, die blades 42 move radially and predominantly linearly outward away from anvil 38 in response to punch 28 linearly pushing the material sheets in the direction of advancing axis 39 while also outwardly pushing the interlocking side wall segments of the material sheets into engagement; this also defines an outside joint button, projecting below the nominal die-side surface of sheet 50, having a generally circular circumference 196 interrupted by three triangular points 198 (see FIG. 12) corresponding to corners 64 (see FIG. 5) of die blades 42. Once interlocking clinch joint 52 has been formed, punch 28 is retracted away from anvil 38 with the assistance of stripper 34. Interlocking clinch joint 52 then securely retains the material sheets 48 and 50 together.

The overlapping construction of die blades 42 and anvil 38 eliminate the undesired downward flow of workpiece material below the plane defined by surface 63 of anvil 38 that otherwise occurs between some conventional die blades and anvils. This overlap of the present invention further reduces excessive material flow in the bottom corners of the joint button and overly thin side wall creation of the joint button. The present invention die blade-to-anvil interface and movement is ideally suited for producing secure, leakproof clinch joints in three layered laminate workpieces used to reduce noise in automotive body panels, such as that shown in FIG. 12.

Figure 9:
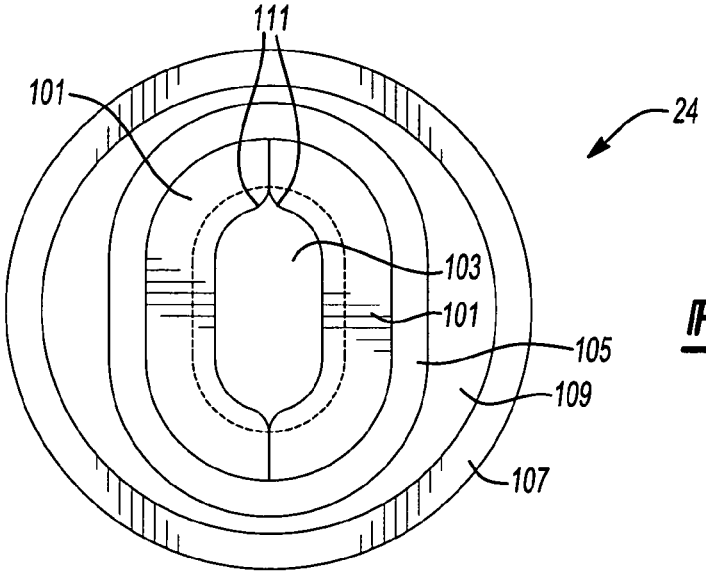
FIG. 9 is a top elevational view showing a die assembly employed in a first alternate embodiment of the present invention apparatus.
Figure 10:
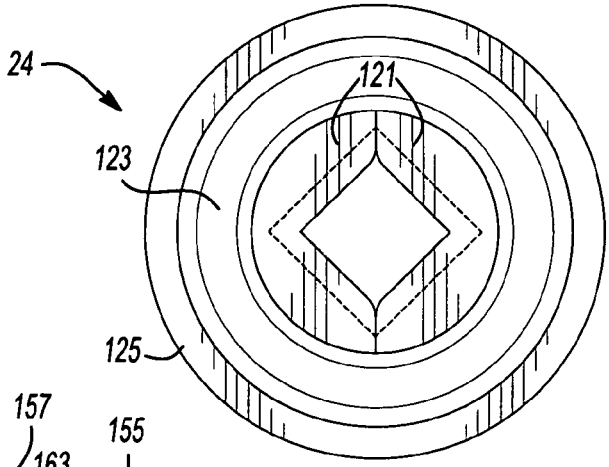
FIG. 10 is a top elevational view showing a die assembly employed in a second alternate embodiment of the present invention apparatus.

Alternate embodiment dies are shown in FIGS. 9 and 10. In FIG. 9, two die blades 101 are biased toward a transversely enlarged anvil 103 by a single O-ring retainer 105. The die blades have a generally I or T-cross sectional shape. A circular die shield 107 is provided to interface with a die body 109 otherwise constructed like the preferred embodiment. Thus, the interlocking clinch joint will have a generally oval button shape interrupted by two opposite points defined by adjacent corners 111 of die blades 101. Caps of die blades 101 overlap the punch surface of anvil 103 as previously disclosed herein. FIG. 10 illustrates a generally diamond or rectangular internal opening between two (or alternately, four) movable die blades 121, which create a corresponding interlocking clinch joint and button shape. An O-ring retainer 123, die shield 125, die body and die blade are otherwise constructed as previously disclosed herein.

Figure 11:
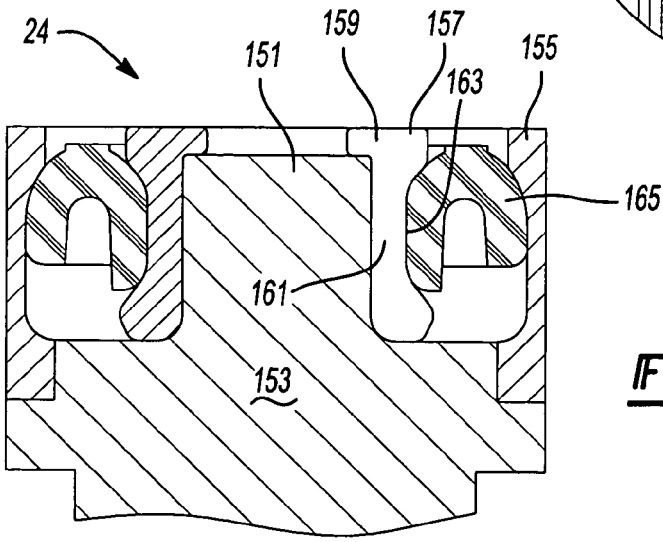
FIG. 11 is a cross sectional view, like that of FIG. 7, showing a die assembly employed in a third alternate embodiment of the present invention apparatus.

A third alternate embodiment is shown in FIG. 11. An anvil 151, die body 153 and die shield 155 are constructed as with the preferred embodiment. Each of three movable die blades 157, however, has a generally T-shape in cross section defined by an anvil-overlapping cap 159, a longitudinally elongated central leg 161 and a retainer-receiving recess 163 in an outer surface. Furthermore, a single, generally inverted-U-cross sectionally shaped retainer 165, made from an elastomeric PVC material, is annularly disposed around die blades 157 for biasing them toward anvil 151. Such a retainer is disclosed in U.S. Pat. No. 6,785,959 entitled "Tool Assembly Employing a Flexible Retainer" which issued to Sawdon, et al. on Sep. 7, 2004, and is incorporated by reference herein.

While the preferred embodiment of the sheet metal fastening apparatus and method have been disclosed, it should be appreciated that various modifications may be made without departing from the scope of the present invention. For example, the shield may be deleted or other punches with similar configurations may be employed in combination with the die assembly of the present invention, although some of the advantages of the present invention may not be achieved.

Alternately, hydraulic or electric actuators could also be employed with the punch and die assemblies of the present invention, although various advantages may not be achieved. It should further be understood that while the terms, upper, lower, inner, outer, radial, longitudinal and others are used to describe the present invention, such usage is to convey relative relationships between various aspects of the present invention and these terms should not be construed as meaning directions since the parts may be inverted or turned sideways in use. While specific materials and shapes have been disclosed, it should be understood that other materials and shapes can be employed without departing from the scope of the invention as defined by the claims. It is intended by the following claims to cover these and any other departures from the disclosed embodiments which fall within the true spirit of this invention.

What is claimed is:

1. A workpiece joining die comprising:

an anvil including a workpiece-interfacing end and at least one side surface, the anvil having a substantially flat workpiece-interfacing end which intersects the at least one side anvil surface at a uniformly shaped corner at all radial cross-sections through the anvil;

movable die blades contacting against the at least one side surface of the anvil when in a nominal condition, each of the die blades including an inwardly extending cap overlapping a portion of the workpiece-interfacing end of the anvil when in the nominal condition; and a biasing member operably retaining the die blades and biasing them toward the anvil;

each adjacent pair of the caps of the die blades contacting against each other to define a closed shape when in the nominal condition; and the caps of the die blades preventing workpiece material from flowing between the die blades and the at least one side surface of the anvil.

2. The die of claim 1 wherein each of the die blades includes an enlarged base inwardly extending in substantially the same direction as the cap, and a groove located between the base and the cap.

3. The die of claim 1 wherein the cap of each die blade has a partially-circular exposed shape adjacent the workpiece-interfacing end of the anvil.

4. The die of claim 1 wherein the cap of each die blade has a partially-oval exposed shape adjacent the workpiece-interfacing end of the anvil.

5. The die of claim 1 wherein the cap of each die blade has a partially-diamond exposed shape adjacent the workpiece-interfacing end of the anvil.

6. The die of claim 1 wherein each of the cross-sections through the uniformly shaped corner has a rounded shape.

7. The die of claim 1 wherein intersecting cap surfaces of adjacent die blades define points outwardly projecting beyond an interior edge of the die blades when they are in the nominal condition.

8. The die of claim 1 wherein the biasing member is an elastomeric and substantially annular retainer which secures the die blades within the die.

9. The die of claim 1 further comprising a substantially cylindrical shield concentrically surrounding a portion of the anvil and the die blades.

10. The die of claim 1 wherein the die blades and the anvil create a clinch joint in workpieces, a majority of an outside surface of the joint formed by the caps having a curved shape.

11. The die of claim 1 wherein each die blade has a substantially I-cross sectional shape.

12. The die of claim 1 wherein the anvil is stationarily mounted to a die body.

13. The die of claim 1 wherein the inwardly extending cap contacts against the workpiece-interfacing end of the anvil when in the nominal condition.

14. A workpiece joining die comprising:

an anvil including a workpiece-interfacing end;

die blades contacting against the anvil when in a first condition and moving away from the anvil when in a joint forming second condition, each of the die blades including an inwardly extending section overlapping a portion of the workpiece-interfacing end of the anvil when in the first condition; and a biasing member annularly surrounding outer surfaces of all of the die blades and biasing them toward the anvil, the entire biasing member being moveable relative to a stationary portion of the die;

each of the die blades including a base extending toward a centerline of the anvil, the base being thicker than a middle section of each die blade, and an annularly shaped groove located at the middle section between the base and the inwardly extending section;

wherein each adjacent pair of the inwardly extending sections of the die blades contacts against each other to define a closed shape overlapping the workpiece-interfacing end of the anvil when in the first condition.

15. The die of claim 14 wherein the inwardly extending section of each die blade has a partially-circular exposed shape adjacent the workpiece-interfacing end of the anvil.

16. The die of claim 14 wherein the inwardly extending section of each die blade has a partially-oval exposed shape adjacent the workpiece-interfacing end of the anvil.

17. The die of claim 14 wherein the inwardly extending section of each die blade has a partially-diamond exposed shape adjacent the workpiece-interfacing end of the anvil.

18. The die of claim 14 wherein intersecting section surfaces of adjacent die blades define points outwardly projecting beyond an interior edge of the die blades when they are in the first condition.

19. The die of claim 14 wherein the biasing member is an elastomeric and substantially annular retainer which secures the die blades within the die.

20. The die of claim 14 further comprising a substantially cylindrical shield concentrically surrounding a portion of the anvil and the die blades, the anvil being stationary relative to the shield.

21. The die of claim 14 wherein the inwardly extending section of the die blades prevent workpiece material from flowing between the die blades and sides of the anvil.

22. The die of claim 14 wherein each die blade has a substantially I-cross sectional shape.

23. The die of claim 14 wherein the anvil is stationarily mounted to a die body.

24. The die of claim 14 wherein the inwardly extending section contacts against the workpiece-interfacing end of the anvil when in the nominal condition.

25. A workpiece joining die comprising:

an anvil including a workpiece-interfacing end and at least one side surface;

movable die blades contacting against the at least one side surface of the anvil when in a nominal condition, each of the die blades including an inwardly extending cap overlapping a portion of the workpiece-interfacing end of the anvil when in the nominal condition, each of the die blades including a recess in an outer surface thereof;

each of the adjacent caps of the die blades contacting each other to define a substantially closed shape when viewed from the workpiece-interfacing end in the nominal condition; and a single biasing member engaging the recesses and annularly surrounding outer surfaces of all of the die blades and biasing them toward the anvil, the entire biasing member being expandable.

26. The die of claim 25 wherein each of the die blades includes an enlarged base inwardly extending in substantially the same direction as the cap, and a groove located between the base and the cap.

27. The die of claim 25 wherein the cap of each die blade has a partially-circular exposed shape adjacent the workpiece-interfacing end of the anvil.

28. The die of claim 25 wherein the cap of each die blade has a partially-oval exposed shape adjacent the workpiece-interfacing end of the anvil.

29. The die of claim 25 wherein the cap of each die blade has a partially-diamond exposed shape adjacent the workpiece-interfacing end of the anvil.

30. The die of claim 25 wherein intersecting cap surfaces of adjacent die blades define points outwardly projecting beyond an interior edge of the die blades when they are in the nominal condition.

31. The die of claim 25 further comprising an elastomeric and substantially annular retainer securing the die blades within the die.

32. The die of claim 25 further comprising a substantially cylindrical shield concentrically surrounding a portion of the anvil and the die blades.

33. The die of claim 25 wherein the caps of the die blades prevent workpiece material from flowing between the die blades and the at least one side surface of the anvil.

34. The die of claim 25 wherein each die blade has a substantially I-cross sectional shape.

35. The die of claim 25 wherein the die blades transversely move away from the anvil in substantially linear directions during joint creation.

36. The die of claim 25 further comprising an outer button of a clinch joint having a substantially curved circumferential shape interrupted by at least two points.

37. The die of claim 25 wherein the anvil is stationarily mounted to a die body.

38. The die of claim 25 wherein the inwardly extending cap contacts against the workpiece-interfacing end of the anvil when in the nominal condition.

39. The die of claim 25 wherein the entire workpiece-interfacing end of the anvil is flat.

* * * * *